United States Patent [19]

Inoue

[11] Patent Number: 4,846,413

[45] Date of Patent: Jul. 11, 1989

[54] SHREDDING MACHINE

[75] Inventor: Kiyoshi Inoue, Tokyo, Japan

[73] Assignee: Inoue-Japax Research Incorporated, Yokohamashi, Japan

[21] Appl. No.: 503,318

[22] Filed: Jun. 10, 1983

[51] Int. Cl.[4] ..... B02C 4/08

[52] U.S. Cl. ..... 241/236; 241/300

[58] Field of Search ..... 83/356.3; 241/236, 197, 241/300, 195

[56] References Cited

U.S. PATENT DOCUMENTS

| | | | |
|---|---|---|---|
| 3,503,108 | 3/1970 | Kidgell et al. . | |
| 3,524,956 | 8/1970 | Rocklin . | |
| 3,630,460 | 12/1971 | Goldhammer | 241/236 |
| 3,711,909 | 1/1973 | Commanday et al. . | |
| 4,061,283 | 12/1977 | Kahmann | 241/197 X |
| 4,292,494 | 9/1981 | Trishevsky et al. . | |

FOREIGN PATENT DOCUMENTS

| | | |
|---|---|---|
| 1278191 | 9/1968 | Fed. Rep. of Germany . |
| 1808155 | 6/1970 | Fed. Rep. of Germany . |
| 2235259 | 1/1974 | Fed. Rep. of Germany . |

*Primary Examiner*—Mark Rosenbaum
*Attorney, Agent, or Firm*—Herbert Dubno

[57] ABSTRACT

A new machine for shredding a scrap material such as waste paper, cutter disks for particular use in shredding machine and a method of making cutter disks are disclosed. The life of the cutter disks is markedly increased and the performance of the shredding machine is improved by spark-depositing a wear-resistant material on the peripheral surface and side surfaces of each cutter disk. A layer of the spark-deposit on the peripheral surface should preferably be greater in thickness and unevenness than a layer of the spark-deposit on the side surfaces.

10 Claims, 4 Drawing Sheets

SHREDDING MACHINE

FIELD OF THE INVENTION

The present invention relates to shredding machines including cutter disks for simultaneous contrarotation for severing scrap material such as wastepaper into pieces, and to such cutter disks in a shredding machine, as well as to a method of preparing these disks.

BACKGROUND OF THE INVENTION

Machines for shredding scrap material for disposal are now in extensive use. Such a shredding machine generally comprises a pair of spaced aparts parallel-extending cutter shafts for simultaneous contrarotation in a cutting zone. Each cutter shaft has a plurality of axially spaced apart cutter disks securely mounted thereon. Each of the cutter disks has side surfaces and a peripheral surface which meets the side surfaces defining cutting edges at the intersections thereof. The cutter disks on one of the cutter shafts are interleaved with those on the other of the cutter shafts so that a plurality of the cutter disks on each of the cutter shafts extend into the spacings between the cutter disks on the other of the cutter shafts with a side of each of the cutter disks on one of the cutter shafts overlapping, and being closely adjacent to, a side of one of the cutter disks on the other of the cutter shafts. The machine further includes a feed unit for supplying scrap material such as wastepaper into the cutting zone, and a drive unit for effecting the simultaneous contrarotation of the cutter shafts to "bite" or roll the supplied material therebetween so that respective portions of the material are forced into the spacings between the neighboring cutter disks on the opposite shafts to sever the material into pieces having respective dimensions corresponding to the spacings between the neighboring cutter disks.

In the shredding machine, the peripheral and side surfaces of each of the cutter disks perform important functions. These surfaces serve to "bite in" the material loaded and to be shredded in the machine and thus require considerable friction therewith. It has thus been proposed to form the peripheral surfaces corrugated or toothed to promote the "bite-in" function. The side surfaces to be overlapped when the opposed cutter disks are contrarotated cannot, however, be so formed because they must be closely spaced adjacent to each other while contramoving simultaneously. The peripheral and side surfaces define cutting edges at the intersections therebetween which must thus be sufficiently sharp and maintained so. In the conventional shredding machine, it has been found that these surfaces including regions of their intersections tend to wear so quickly that the machine soon becomes incapable of operating smoothly and even inoperable.

OBJECTS OF THE INVENTION

The present invention, therefore, seeks to provide a shredding machine which is capable of operating satisfactorily for practically an unlimited time span.

The invention also seeks to provide cutter disks for particular use in a shredding machine whose cutters practically do not require replacement.

The invention further seeks to provide a new and improved method of preparing cutter disks for particular use in a shredding machines.

SUMMARY OF THE INVENTION

According to the present invention there is provided, in a first aspect thereof, a shredding machine of the type described wherein the cutter disks each have at least region of the aforementioned intersections coated with a layer of a wear-resistant material spark-deposited thereon.

The invention also provides cutter disks for particular use in a shredding machine of the type described, which cutter disks each have at least region of the aforementioned intersections coated with a layer of a wear-resistant material spark-deposited thereon.

The invention further provides a method of preparing cutter disks for particular use in a shredding machine of the type described which method includes the step of spark-depositing a wear-resistant material on each of at least regions of the aforementioned intersections.

BRIEF DESCRIPTION OF THE DRAWING

These and other features of the present invention as well as advantages thereof will become apparent from a reading of the following description when taken with reference to the accompanying drawing in which.

SPECIFIC DESCRIPTION

Figure 1:
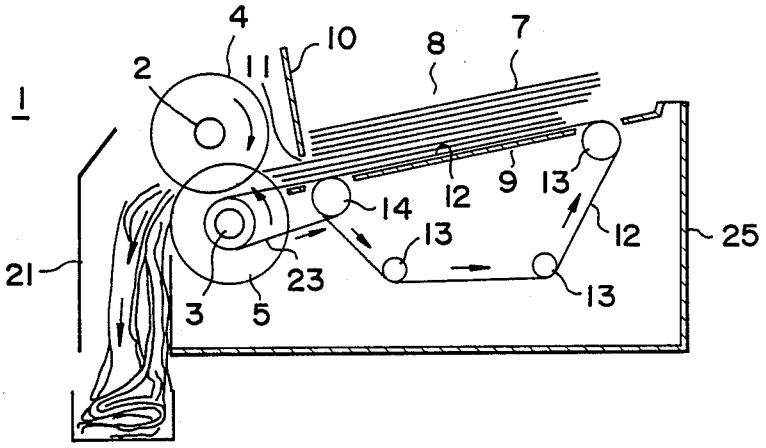
FIG. 1 is a side elevational view, partly in section, diagrammatically illustrating a shredding machine of conventional design but with cutter disks according to the invention.
Figure 2:
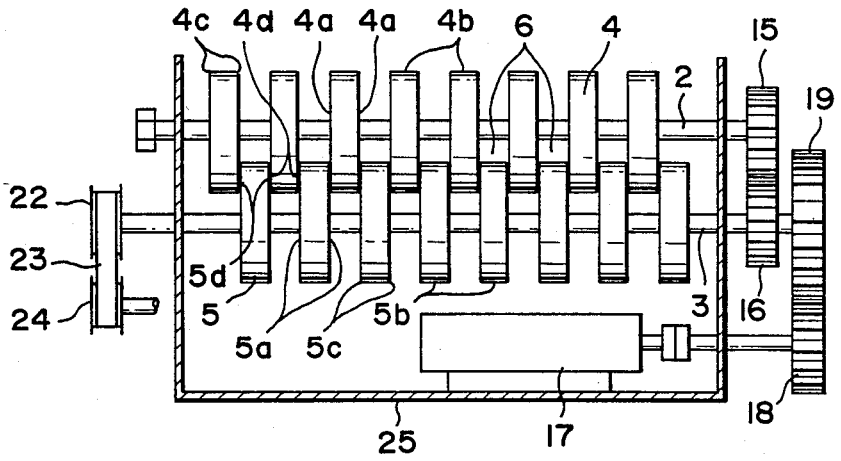
FIG. 2 is a front view, basically in section, of the machine shown in FIG. 1.

As shown in FIGS. 1 and 2, a shredding machine basically of conventional design is generally designated at 1 and includes a pair of spaced apart generally parallel-extending cutter shafts 2 and 3 for simultaneous contrarotation. Each of the cutter shafts 2, 3 has a respective plurality of axially spaced apart cutter disks 4, 5 securely mounted thereon. The cutter disks 4, 5 have respective opposed parallel side surfaces 4*a*, 5*a* and respective peripheral surfaces 4*b*, 5*b* which meet the side surfaces 4*a*, 5*a* defining cutting edges at the respective intersections 4*c*, 5*c* thereof (FIG. 2). Furthermore, the cutter disks 4 on the cutter shaft 2 are interleaved with the cutter disks 5 on the cutter shaft 3, so that a plurality of the cutter disks on each of the cutter shafts extend into the spacings 6 between the cutter disks on the other of the cutter shafts. A side 4*d* of the cutter disks 4 on one cutter shaft 2, overlaps, and is closely adjacent to, a side portion 5*d* of the cutter disks 5 on the other cutter shaft 3.

A scrap material such as a pile of waste material 7 is loaded in a receptacle 8 constituted by an inclined bottom plate 9 and an adjustment plate 10 and apertured at its outlet side 11 (FIG. 1). An endless belt 12 turning on rollers 13 and 14 passes through the aperture 11 on or above the plate 9 and, as the roller 14 is driven, is displaced in the direction of the arrows to supply a portion of the loaded scrap material 7 through the aperture 11 into the cutting zone.

The cutting shafts 2, 3 have gears 15 and 16 secured thereto respectively which are intermeshed (FIG. 2). The gear 16 is driven by a motor 17 via gear transmissions 18, 19. Thus, the cutter shafts 3, 2 are simultaneously contrarotated by the motor 17 to simultaneously contrarotate the cutter disks 5 on the shaft 3 and the cutter disks 4 on the shaft 2 to draw the supplied portion of the scrap material 7 therebetween. As a result, respective portions of the scrap material 7 are forced into the spacings 6 between the neighboring cutter disks 4, 5 on the respective cutter shafts 2, 3 to sever the material 7 into pieces 20 having respective dimensions corresponding to the spacings 6 between the neighboring cutter disks 4, 5. The pieces 20 ejected from between the contrarotating cutter disks 4, 5 are collected into a casing 21 for disposal.

The cutter shaft 3 has a pulley 22 secured thereto which is connected via an endless belt 23 to a pulley 24 which is secured to a shaft for the roller 14 to displace the endless belt 12. The cutter disks 4, 5 and the motor 17 are accommodated in a housing 25. The cutter shafts 2, 3 carrying the cutter disks 4, 5 in a parallel relationship are journalled through the side walls of the housing 25.

Each of the cutter disks 4, 5, cylindrical in shape, is shown as having a smooth peripheral surface 4*b*, 5*b*. However, the peripheral surface 4*b*, 5*b* may not be smooth but may be formed with geared or toothed corrugations to increase their friction with the supplied material 7. Each cutter disk is typically composed of a hardened steel which should withstand frictional wear. In a conventional shredding machine of the type described, however, it has been found that the peripheral surfaces 4*b*, 5*b* and also side portions 4*d*, 5*d* as well, especially regions of the intersections 4*c*, 5*c* therebetween, tend to wear so that the machine becomes soon incapable of operating smoothly or even operable no longer.

In accordance with the present invention, each of the cutter disks 4, 5 on one or the other of the cutter shafts 2, 3 has a layer of a wear-resistant material deposited on, and diffusion-bonded with, its substrate by spark discharge, at least along a region of the intersection 4*c*, 5*c* defined between the peripheral surfaces 4*b*, 5*b* with the side portions 4*d*, 5*d* of the overlapping, and closely adjacent neighboring cutter, disks.

Figure 3A:
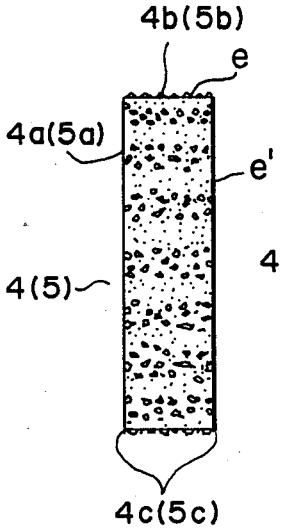
FIGS. 3A and 3B are respective edge and side views of a cutter disk formed with spark-deposited layers according to the present invention.
Figure 3B:
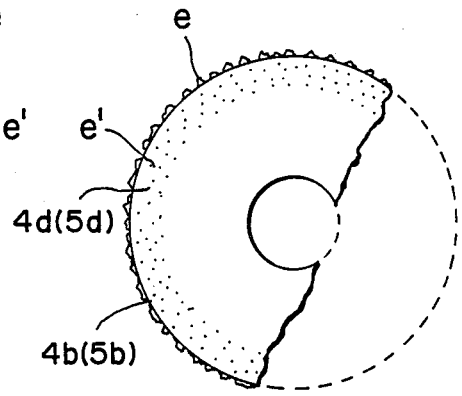

FIGS. 3A and 3B show a cutter disk 4 (or 5) formed with such layers e, e′ of wear-resistant material spark-deposited upon its peripheral surface 4*b* (5*b*) and upon a side or rim portion 4*d* (5*d*) on each of its two opposed side surfaces 4*a* (5*a*), thus including a region of the intersection 4*c* (5*c*). In spark deposition, a material is impulsively molten and instantaneously deposited onto a metallic substrate by the action of electrical spark discharge. The unique feature of spark-deposition processes is that the deposited material partly diffuses into the substrate, thus creating an extremely firm bond between the layer of deposit and the substrate. By constituting the depositable material with a wear-resistant material such as tungsten carbide, a highly wear-resistant layer of the deposit e, e′ can be formed upon the peripheral surface 4*b* (5*b*) and the side portion surfaces 4*d* (5*d*) of each cutter disk 4, 5 with a tenacious diffusion bond therewith.

A preferred method of forming layers e, e′ of a wear-resistant material deposited along a region of interest on each of the cutter disks 4, 5 by utilizing a typical spark-deposition process is described with reference to FIGS. 4 and 6.

Figure 4:
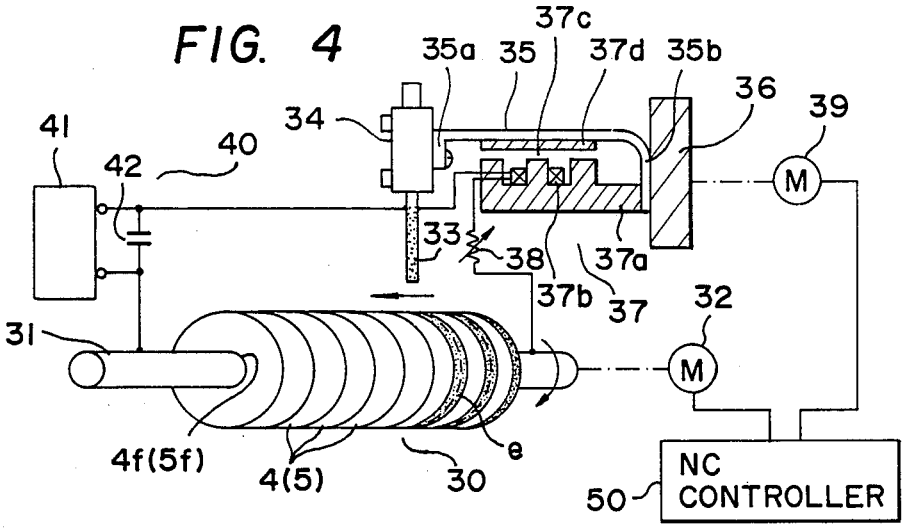
FIG. 4 is a schematic view diagrammatically illustrating a spark-deposition arrangement operating to form layers of wear-resistant material in one form on cutter disks arranged in a roll or in a side by side and mutually contacting relationship.

Referring to FIG. 4, a plurality of cutter disks 4 (5) is shown arranged in a side by side and mutually contacting relationship to form a roll 30 mounted securely on a horizontally extending supporting shaft 31 which passes through and is snugly fitted in the hubs 4*f* (5*f*) of the disks 4 (5), and with which a motor 32 is drivingly connected. A spark-deposition electrode 33, composed of a wear resistant material such a tungsten carbide, is shown oriented vertically and juxtaposed with the roll 30 across a small spacing therebetween. The electrode 33 is securely attached to a support 34 which in turn is carried by one end 35*a* of a leaf or plate spring 35 whose bent other end 35*b* is secured to a fixed wall of a carriage 36. A core member 37*a* of an electromagnet 37 extends from the bent end portion 35*b* of the spring 35 parallel with and closely spaced from a magnetic plate 37*d* attached to the spring 35. A solenoid 37*b* wound on the pole shoes 37*c* of the electromagnet 37 is connected electrically across the electrode 33 and the conductive shaft 31 and hence the roll 30 via a variable resistor 38.

A spark-deposition power supply 40 comprises a DC source 41 whose output terminals are connected across a capacitor 42, of which one output terminal is electrically connected to the electrode 33 and the other output terminal is electrically connected to the conductive shaft 31 and hence to the roll 30. The capacitor 42 is cyclically charged by the DC source 41, the charge stored on the capacitor 42 in each charging cycle being discharged through the spacing between the electrode 33 and the roll 30. In the electromagnet 37 the solenoid 37*b* responds to, and is energized by, the cyclically varying voltage across the capacitor 42 to cyclically attract the magnetic member 37*d* against the spring force of the supporting member 35. As a result, the electrode 33 is driven to reciprocate, thus cyclically making and breaking contact with the roll 30. In each cycle of the reciprocation, the capacitor 42 impulsively discharges the stored energy between the roll 30 and the approaching electrode 33, effecting a spark discharge therebetween which serves to impulsively melt the electrode material to form a molten droplet thereof, which is instantaneously deposited and left on the point of the spark discharge and allowed to cool thereon as the electrode breaks the contact with and is retracted from the roll 30. The deposited material partially diffuses into the substrate of the roll 30 under heat and by the action of electrotransportion created by the spark discharge, thus forming a firm bond with the substrate.

Figure 5:
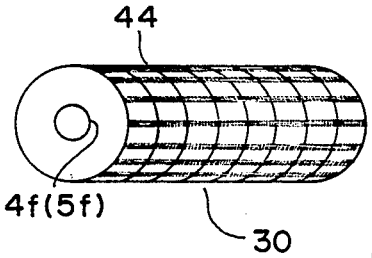
FIG. 5 is a perspective view illustrating such a roll having a plurality of parallel layers of spark deposit formed in another form thereon.

As the electrode 33 reciprocates, the electrode carriage 36 and the roll 30 are relatively displaced to progressively develop a desired layer of the deposit uniformly over or along a desired localized area on the peripheral surface of the roll 30. For example, the carriage 36 is translationally displaced by a motor 39 to cause the electrode 33 to sweep from the right-hand end to the left-hand end of the roll 30 to form thereon a layer of the deposit in the form of a band extending parallel with the shaft 31 and, thereupon, the shaft 31 is rotated by the motor 32 to rotate the roll 30 by a given angle. Then the carriage 36 is again translationally driven by the motor 39 to cause the electrode 33 to sweep from the left-hand end to the right-hand end of the roll 30. This cycle is repeated until the whole peripheral surface of the roll 30 is swept. By adjusting the angle of rotation of the roll 30 in each cycle, either a continuous layer or a set of discrete, parallel band-shaped strips 44 of the deposit as shown in FIG. 5 is formed on the peripheral surface of the roll 30. It should be noted that the layer of each strip of the deposit is formed extending over the boundaries of the neighboring cutter disks 4, 5 to provide a highly sharp intersection **4*c*, 5*c* between the peripheral surface 4*b*, 5*b* and the side 4*a*, 5*a* on each cutter disk 4,5**.

Alternatively, the motor 39 is driven to position the electrode 33 above the right hand end of the roll 30 and then the motor 32 is driven to give a turn to the roll 30. Thereupon, the electrode 33 is repositioned to translationally move by a distance towards the left, and the cycle is repeated. By properly adjusting the distance of the translational movement of the electrode 33 in each cycle, it is possible to form either a continuous layer of the deposit or a set of spaced, ring-shaped parallel strips of the deposit on the peripheral surface of the roll 30. It has been found to be advantageous to form each ring-shaped strip of the deposit as extending over the boundary of two neighboring cutter disks 4 (5) in the roll 30 as shown in FIG. 4. In this manner, here again, a highly sharp intersection **4*c*, 5*c* between the peripheral surface 4*b*, 5*b* and the side 4*a*, 5*a* of each cutter disk 4, 5** is provided.

The operation of the motors 32 and 39 to effect the relative displacement between the electrode 33 and the roll is controlled by an NC (numerical control) unit 50.

If it is desirable that a spark-deposited layer of wear-resistant material e on the peripheral surface of each cutter disk 4, 5 have a greater thickness and a greater irregularity or surface roughness to increase its friction with the scrap material, a spark-deposited layer of greater roughness can be obtained by employing a succession of spark-discharge pulses with greater peak current and/or longer duration. In the arrangement illustrated, a capacitor 42 with greater capacitance can be employed to obtain greater roughness of the spark-deposit.

A plurality of cutter disks 4, 5 is advantageously prepared by electroerosively cutting a cylindrical blank of a steel roll with multiple parallel wires on a traveling-wire electroerosive cutting machine. Disks 4, 5 so prepared are arranged in a side by side and mutually contacting relationship as shown in FIG. 4 and can be formed with spark-deposited layers of a wear-resistant material in a manner as described.

Figure 7:
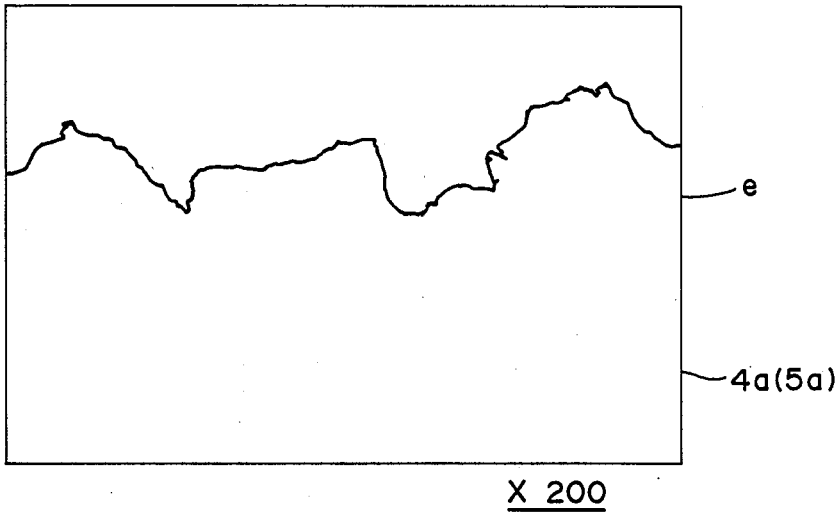
FIGS. 7 and 8 are microscopic views showing layers of spark deposit formed on the peripheral and side surface, respectively, of a cutter disk.

FIG. 7 shows a microscopic cross-sectional view with a 200 times magnification of a layer of wear-resistant material e spark-deposited upon the peripheral surface **4*b*, 5*b* of a carbonsteel cutter disk 4 or 5 from an electrode 33** composed by weight of 5% iron, 5% nickel, 1% boron and the balance tungsten carbide. The electrode was vibrated at a frequency of 300 Hz and spark-discharge pulses had a peak current of 70 amperes, a pulse duration of 250 μseconds and a pulse interval of 20 μseconds. The deposited layer had a Vicker's hardness (Hv) of 1400 and a surface roughness of 0.1 mm (Hmax).

Materials suitable for spark-deposition upon a cutter disk 4, 5 include titanium carbide, tantalum carbide, titanium nitride, silicon carbide, hafnium carbide, tungsten carbide and combinations of these materials.

Figure 6:
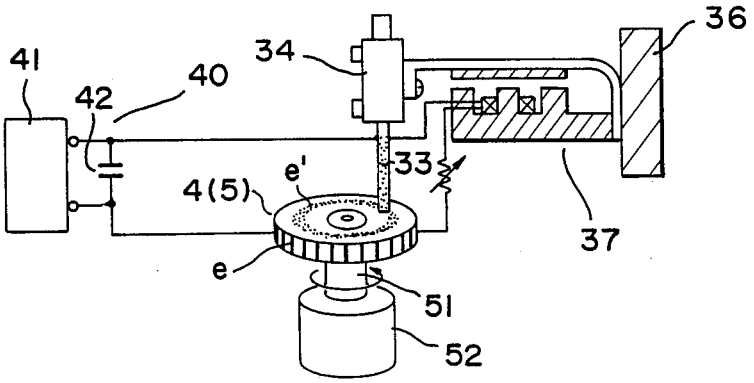
FIG. 6 is a schematic view diagrammatically illustrating a spark-depositing arrangement operating to form a ring-shaped layer of wear-resistant material spark-deposited on a side of the cutter disk having parallel layers of spark-deposit applied on the peripheral surface thereof according to the arrangement of FIG. 4.

FIG. 6 shows an arrangement for spark-depositing a layer of wear-resistant material e′ on a side portion **4*d* or 5*d* of a respective of a cutter disk 4 or 5 whose peripheral surface has spaced parallel bands e of spark deposit already applied thereon. In this arrangement, the disk 4 or 5 is secured to a shaft 51 extending vertically and rotated by a motor 52. The electrode 33 is juxtaposed with the side portion 4*d* or 5*d* of the cutter disk 4 or 5 and vibrated to intermittently make and break contact with the side 4*d*, 5*d* as the disk 4, 5 is rapidly rotated by the motor 52. A succession of electrical pulses is passed from the power supply 40 to produce intermittent spark discharges between the vibrating electrode 33 and the rotating cutter disk 4, 5 to form a layer e′ of deposit along the side portion 4*d*, 5*d*** in the form of a ring.

It is desirable that a spark-deposited layer of wear-resistant material e′ on the side portion **4*d*, 5*d* of each cutter disk 4, 5 have a minimum thickness and be much smoother than that of material e on the peripheral surface 4*a*, 5*a*** thereof.

Figure 8:
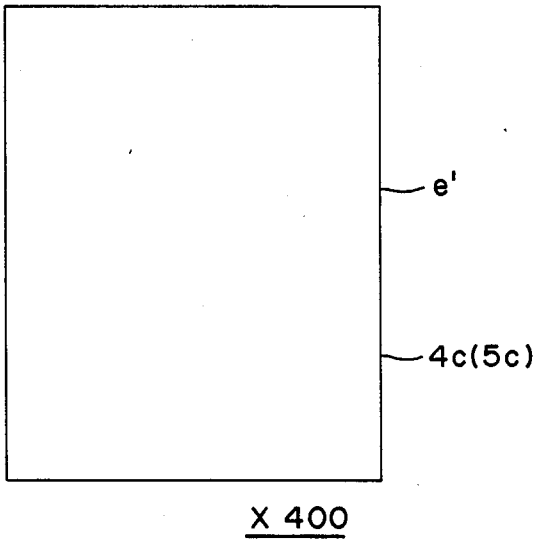

FIG. 8 is a microscopic view with a 400 times magnification of a layer of wear-resistant material e′ spark-deposited upon a side portion **4*d*, 5*d* from the electrode. The cutter disk 4, 5 was rotated at 1000 rpm and the material of the electrode 33, the vibration frequency thereof and the spark parameters were the same as those described in connection with FIG. 7. The layer e′ has the same Vicker's hardness as described in connection with FIG. 7** but a surface roughness of 3 to 4 μHmax.

Figure 9A:
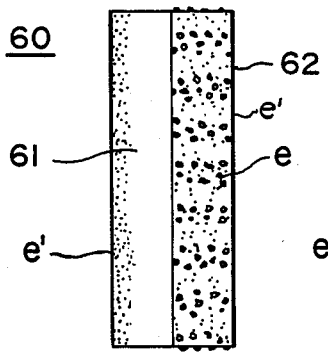
FIGS. 9A and 9B are respective edge and side views illustrating a composite cutter disk according to another embodiment of the invention.
Figure 9B:
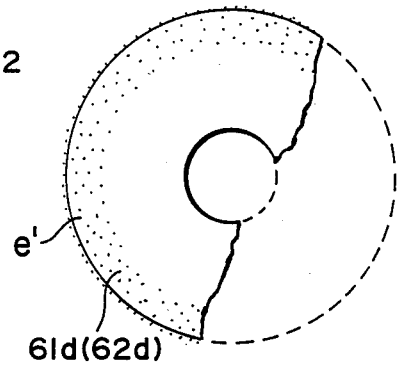

FIGS. 9A and 9B show a composite disk 60 which may serve as each of disks 4, 5 in the shredding machine 1 of FIG. 1. The composite disk 60 consists of a cutter disk 61 and a feed disk 62 secured together. The cutter disk 61 has its peripheral surface formed with a thin and smoother layer of spark-deposit e′ and the feed disk 62 has its peripheral surface formed with a thick and rougher layer of spark-deposit e. The exposed one side portions **61*d*, 62*d* of each of the cutter and feed rollers 61, 62** is formed with a thin and smoother layer of spark-deposit e′.

In applying a layer of spark-deposit onto a portion of each cutter disk 4, 5 in the practice of the present invention, it should be understood that any of various known spark-deposition processes other than that illustrated and described can be employed.

What is claimed is:

1. In a shredding machine having:

a pair of spaced apart generally parallel-extending cutter shafts for simultaneous contrarotation in a cutting zone;

a plurality of axially spaced apart cutter disks securely mounted on each of said cutter shafts, said cutter disks having opposed generally parallel side surfaces and peripheral surfaces which meet said side surfaces defining cutting edges at the intersections therebetween, the cutter disks on one of said cutter shafts being interleaved with those on the other of said cutter shafts so that a plurality of said cutter disks on each of said cutter shafts extend into the spacings between the cutter disks on the other of said cutter shafts with side portions of the cutter disks on one of said cutter shafts overlapping and being closely adjacent to side portions of the cutter disks on the other of said cutter shafts;

feed means for supplying scrap material between the interleaved cutter disks;

drive means for effecting said simultaneous contrarotation of said cutter shafts to draw the supplied scrap material therebetween so that a proportion of the material is forced into the spacing between neighboring cutter disks on each of said cutter shafts to sever said supplied scrap material into pieces having respective dimensions corresponding to the spacings between said neighboring disks; and means for collecting said pieces of the scrap material;

the improvement wherein said interleaved cutter disks have at least along said overlapping side portions coatings of layers of a wear-resistant material thereon, at least some of said cutter disks each having also at least over a portion of the peripheral surface thereof a coating of said material spark-deposited thereon, said at least some cutter disks each have a set of spaced apart layers, each in the form of a strip extending generally parallel to said shafts, of said material spark-deposited on the peripheral surface thereof.

2. The improvement defined in claim 5 wherein at least some of said cutter disks each have a continuous layer in the form of a ring of said material spark-deposited over each of said overlapping side portions.

3. The improvement defined in claim 1 wherein said layers on the peripheral surfaces are greater in thickness than said layers on said overlapping side portions.

4. The improvement defined in claim 8 wherein said layers on said peripheral surfaces are greater in surface unevenness than said layers on said overlapping side portions.

5. In a shredding machine having:

a pair of spaced apart generally parallel-extending cutter shafts for simultaneous contrarotation in a cutting zone;

a plurality of axially spaced apart cutter disks securely mounted on each of said cutter shafts, said cutter disks having opposed generally parallel side surfaces and peripheral surfaces which meet said side surfaces defining cutting edges at the intersections therebetween, the cutter disks on one of said cutter shafts being interleaved with those on the other of said cutter shafts so that a plurality of said cutter disks on each of said cutter shafts extend into the spacings between the cutter disks on the other of said cutter shafts with side portions of the cutter disks on one of said cutter shafts overlapping and being closely adjacent to side portions of the cutter disks on the other of said cutter shafts;

feed means for supplying scrap material between the interleaved cutter disks;

drive means for effecting said simultaneous contrarotation of said cutter shafts to draw the supplied scrap material therebetween so that a proportion of the material is forced into the spacing between neighboring cutter disks on each of said cutter shafts to sever said supplied scrap material into pieces having respective dimensions corresponding to the spacings between said neighboring disks; and means for collecting said pieces of the scrap material;

the improvement wherein said interleaved cutter disks have at least along said overlapping side portions coatings of layers of a wear-resistant material thereon, at least some of said cutter disks each having also at least over a portion of the peripheral surface thereof a coating of said material spark-deposited thereon, at least some of said cutter disks being each formed by a composite disk having a cutter disk portion and a feed disk portion divided by a plane intersecting said composite disk parallel with the side surfaces thereof, said cutter disk portion having the peripheral surface thereof coated with a layer of said material of relative small thickness and surface unevenness and said feeder disk portion having the peripheral surface thereof coated with a layer of said material of relatively large thickness and surface unevenness, said overlapping side portions having such layers of relatively small thickness and unevenness.

6. In a set of cutter disks for use in a shredding machine having:

a pair of spaced apart generally parallel-extending cutter shafts for simultaneous contrarotation in a cutting zone;

a plurality of axially spaced apart cutter disks securely mounted on each of said cutter shafts, said cutter disks having opposite generally parallel side surfaces and peripheral surfaces which meet said side surfaces defining cutting edges at the intersections therebetween, the cutter disks on one of said cutter shafts being interleaved with those on the other of said cutter shafts so that a plurality of said cutter disks on each of said cutter shafts extend into the spacings between the cutter disks on the other of said cutter shafts with side portions of the cutter disks on one of said cutter shafts overlapping, and being closely adjacent to, side portions of the cutter disks on the other of said cutter shafts;

feed means for supplying scrap material between the interleaved cutter disks;

drive means for effecting simultaneous contrarotation of said cutter shafts to draw the supplied scrap material therebetween so that a proportion of the material is forced into the spacing between neighboring cutter disks on each of said cutter shafts to sever said supplied scrap material into pieces having respective dimensions corresponding to the spacings between said neighboring cutter disks; and means for collecting said pieces of the scrap material, the improvement which comprises:

said interleaved cutter disks being at least along said overlapping side portions coated respectively with layers of a wear-resistant material thereon, at least some of said cutter disks each also having at least over a portion of a peripheral surface thereof a coating of said material spark-deposited thereon, said at least some cutter disks each having a set of spaced apart layers, each in the form of a strip extending generally parallel to said shafts of said material spark-deposited on the respective peripheral surface thereof.

7. The improvement defined in claim 6 wherein at least some of said cutter disks each have a continuous layer in the form of a ring of said material spark-deposited over each of said overlapping side portion.

8. The improvement defined in claim 6 wherein said layers on the peripheral surfaces are greater in thickness than said layers on said overlapping side side portions.

9. The improvement defined in claim 8 wherein said layers on said peripheral surfaces are greater in surface unevenness than said layers on said overlapping side portions.

10. In a set of cutter disks for use in a shredding machine having:

a pair of spaced apart generally parallel-extending cutter shafts for simultaneous contrarotation in a cutting zone:

a plurality of axially spaced apart cutter disks securely mounted on each of said cutter shafts, said cutter disks having opposite generally parallel side surfaces and peripheral surfaces which meet said side surfaces defining cutting edges at the intersections therebetween, the cutter disks on one of said cutter shafts being interleaved with those on the other of said cutter shafts so that a plurality of said cutter disks on each of said cutter shafts extend into the spacings between the cutter disks on the other of said cutter shafts with side portions of the cutter disks on one of said cutter shafts overlapping, and being closely adjacent to, side portions of the cutter disks on the other of said cutter shafts;

feed means for supplying scrap material between the interleaved cutter disks;

drive means for effecting simultaneous contrarotation of said cutter shafts to draw the supplied scrap material therebetween so that a proportion of the material is forced into the spacing between neighboring cutter disks on each of said cutter shafts to sever said supplied scrap material into pieces having respective dimensions corresponding to the spacings between said neighboring cutter disks; and means for collecting said pieces of the scrap material, the improvement which comprises:

said interleaved cutter disks being at least along said overlapping side portions, coated respectively with layers of a wear-resistant material thereon, at least some of said cutter disks each also having at least over a portion of a peripheral surface thereof a coating of said material spark-deposited thereon, at least some of said cutter disks each being a composite disk having a cutter disk portion and a feed disk portion divided by a plane intersecting said composite disk parallel with the side surfaces thereof, said cutter disk portion having the peripheral surface thereof coated with a layer of said material of relative small thickness and surface unevenness and said feeder disk portion having the peripheral surface thereof coated with a layer of said material of relatively large thickness and surface unevenness, said overlapping side portions having layers of relatively small thickness and unevenness.

* * * * *